United States Patent [19]

Shaw

[11] Patent Number: 4,960,282

[45] Date of Patent: Oct. 2, 1990

[54] GOLF BALLS

[75] Inventor: Michael Shaw, Wakefield, England

[73] Assignee: Dunlop Limited, United Kingdom

[21] Appl. No.: 418,235

[22] Filed: Oct. 6, 1989

Related U.S. Application Data

[63] Continuation-in-part of Ser. No. 260,069, Oct. 20, 1988, Pat. No. 4,877,252.

[30] Foreign Application Priority Data

Nov. 3, 1987 [GB] United Kingdom ..... 8725685

[51] Int. Cl.[5] ..... A63B 37/14

[52] U.S. Cl. ..... 273/232; 273/213

[58] Field of Search ..... 273/232, 233, 235 R, 273/62, 213

[56] References Cited

U.S. PATENT DOCUMENTS 4,877,252 10/1989 Shaw ..... 273/232

*Primary Examiner*—George J. Marlo

*Attorney, Agent, or Firm*—Stevens, Davis, Miller & Mosher

[57] ABSTRACT

A golf ball with a plurality of dimples in its spherical outer surface has at least 10% of said dimples so disposed relative to one another that any two adjacent dimples overlap. The minimum overlap width is greater than 0.02 inches (0.508 mm).

12 Claims, 5 Drawing Sheets

GOLF BALLS

This application relates to golf balls, and is a continuation-in-part of co-pending application Ser. No. 260,069 filed 20 Oct. 1988, now U.S. Pat. No. 4,877,252.

It is well known to provide golf balls with a plurality of dimples in the spherical surface of the ball and there have been many previous proposals to distribute those dimples in a repeating pattern. It is understood by those skilled in the relevant art that the dimple pattern, together with any non-dimpled areas, affects the playing characteristics of the ball. In particular, the flight path and flight distance of a golf ball, as well as the degree of air-resistance encountered during flight, can be greatly affected by the dimple pattern.

According to said co-pending application, the aforementioned playing characteristics can be considerably enhanced by so arranging the dimples on the surface of the ball that at least some adjacent dimples touch or overlap.

Said co-pending application therefore provides a golf ball having a plurality of dimples in its spherical outer surface, in which at least 10% of the dimples are so disposed relative to one another that the peripheries of any two adjacent dimples extend inside each other to form an overlapping region.

In a first aspect of said co-pending application, all the dimples are of equal diameter and the maximum width of the overlapping region is in the range 1% to 20% of the diameter of any one of the overlapping dimples.

In a second aspect of said co-pending application, the dimples are of two or more different diameters and the maximum width of the overlapping region is in the range 1% to 20% calculated on the diameter of the larger of any two of the overlapping dimples.

It has now been found that the aerodynamic performance of such a golf ball is considerably enhanced when the minimum width of the region formed by the overlapping of two adjacent dimples is greater than 0.02 inches (0.508 mm).

Accordingly, the present invention provides a golf ball having in its spherical outer surface a plurality of dimples, wherein at least 10% of said dimples are so disposed relative to one another that any two of said dimples which are adjacent each other extend inside each other to form an overlapping region, the minimum width of said overlapping region being greater than 0.02 inches (0.508 mm).

Preferably, at least 20% of said dimples extend inside each other fo form an overlapping region.

In accordance with preferred embodiments of the present invention, the minimum width of said overlapping region may be greater than 0.025 inches (0.635 mm), for example greater than 0.03 inches (0.762 mm).

In a further embodiment of the present invention, all said dimples are of equal diameter.

In another embodiment, said dimples are of different diameters and the width of said overlapping region is calculated on the diameter of the larger of any two of said overlapping dimples.

Preferably, said dimples are arranged in a repeating pattern over the whole spherical outer surface of said ball, said pattern being defined by projecting on to said spherical outer surface the edges of a regular polyhedron selected from the group consisting of a cube, an octahedron, a dodecahedron, an icosahedron and an icosidodecahedron.

Said dimples may suitably be of circular plan view.

Such dimples may have a three-dimensional configuration selected from the group consisting of part-spherical, part-ellipsoid, conical and frusto-conical.

Alternatively, said dimples may be of non-circular plan view. For example, said non-circular plan view may be one selected from the group consisting of triangular, rectangular and polygonal. Such dimples may have a three-dimensional configuration selected from the group consisting of tetrahedral, parallelepiped and pyramidal.

The pattern of a golf ball according to the present invention can be so arranged that when the ball is played, the dimple pattern will influence the axis of spin. Thus, it is possible to design the flight characteristics of such a ball to have a high degree of control and accuracy.

Although it is not intended that the present invention be construed according to any particular theory, it is believed that the touching or overlapping of the dimples reduces the effective diameter of the ball, thus reducing the "drag" encountered by the ball during flight. This reduction in "drag" has a corresponding beneficial effect on distance performance when the ball is played.

Two preferred embodiments of the present invention will be illustrated, merely by way of example, in the following description and with reference to the accompanying drawings. In the drawings.

In the drawings, like numerals denote like parts in the following sets of Figures.

FIGS. 1 and 2;

FIGS. 3 and 4;

FIGS. 5, 6, 7, and 8 .

Figure 1:
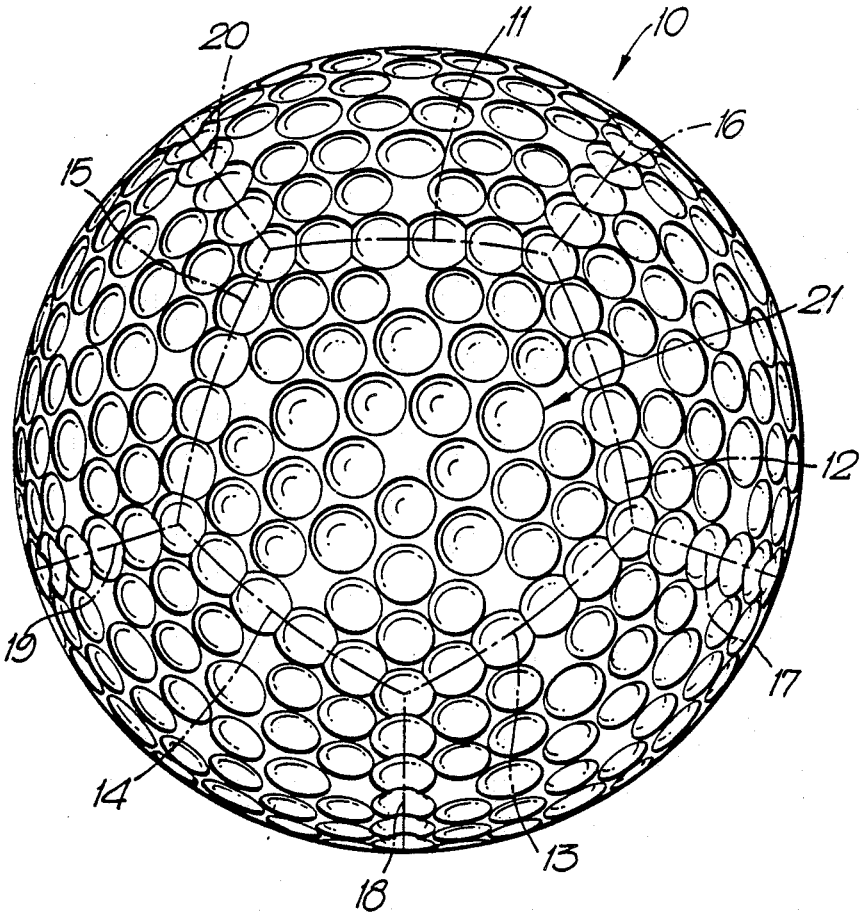
FIG. 1 is a perspective view of a golf ball according to a first preferred embodiment of the present invention.

In FIG. 1, a golf ball (indicated generally at 10) has a repeating dimple pattern indicated by chain-dotted lines 11, 12, 13, 14, 15, 16, 17, 18, 19 and 20. The said chain-dotted lines divide the spherical surface of the ball into twelve equal regular pentagons (one pentagon is indicated at 21 in FIG. 1).

Figure 2:
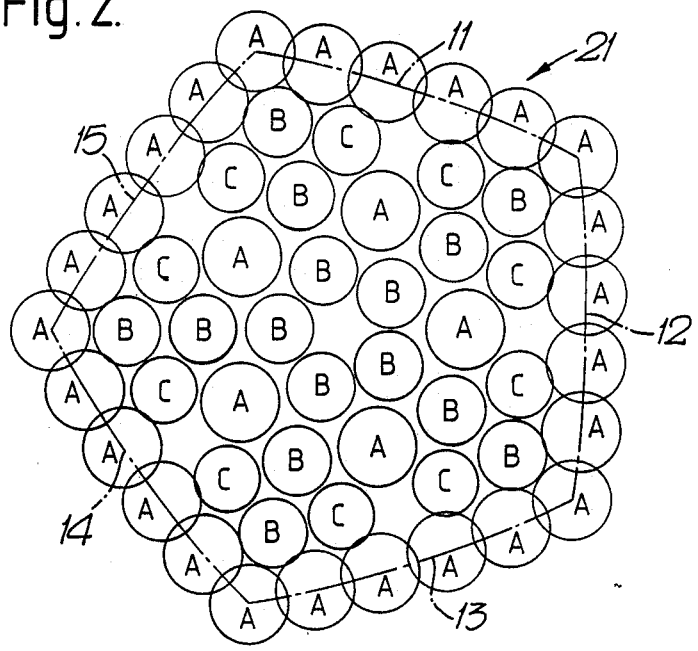
FIG. 2 is an enlarged view of a portion of the ball shown in FIG. 1.

In FIG. 2, pentagon 21 contains dimples of three different sizes, these being marked A, B and C respectively.

Several pairs of adjacent dimples in each pentagon overlap or touch as shown in the drawings. The ball illustrated in FIGS. 1 and 2 had the following dimple diameters :

| | |
|---|---|
| A | 3.810 mm |
| B | 3.353 mm |

-continued

| | |
|---|---|
| C | 3.251 mm |

The dimple pattern was dodecahedral and comprised twelve pentagons. The dimples numbered 500 in all and comprised:

200 of Diameter A 180 of Diameter B and 120 of Diameter C.

Figure 3:
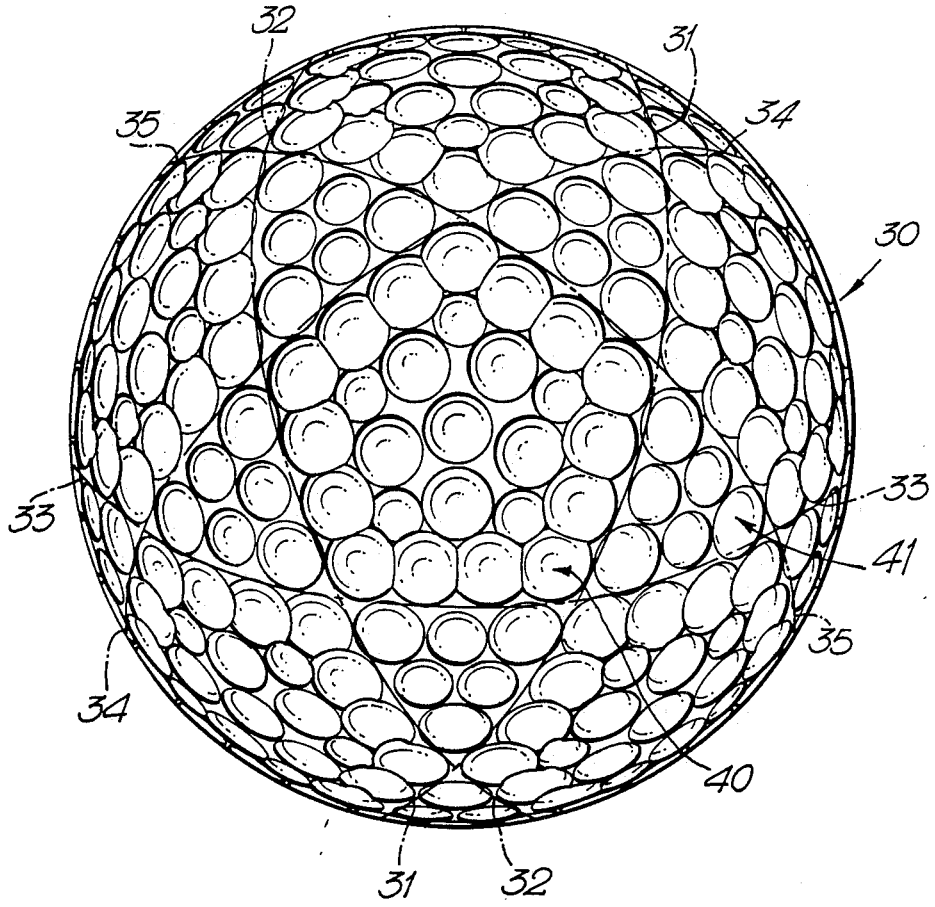
FIG. 3 is a perspective view of a golf ball according to a second preferred embodiment of the present invention.

FIG. 3 shows a golf ball (indicated generally at 30) having a repeating dimple pattern indicated by chain-dotted lines 31, 32, 33, 34, and 35.

(Lines 31,32, 33,34, and 35 represent five of the six "great circles" of the ball, the sixth "great circle" not being visible in the view shown in FIG. 3).

It will be seen that the "great circles" divide the spherical surface of the ball into a total of twelve pentagons and twenty triangles. In FIG. 3, one pentagon 40 and one triangle 41 is indicated.

Figure 4:
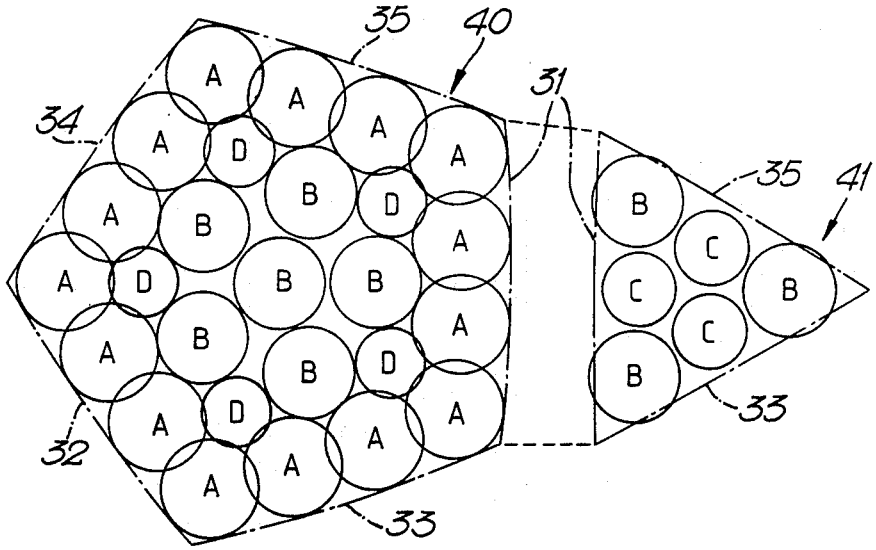
FIG. 4 is an enlarged view of a portion or the ball shown in FIG. 3.

Referring now to FIG. 4, pentagon 40 contains dimples of three different sizes, these being marked A, B, and D respectively. Adjacent triangle 41 contains dimples of two different sizes, one of these sizes being marked B (as in pentagon 40) and the other being marked C. The several adjacent dimples overlap or touch as indicated in the drawings.

The ball illustrated in FIGS. 3 and 4 had the following dimple diameters:

| | |
|---|---|
| A | 4.250 mm |
| B | 4.000 mm |
| C | 3.300 mm |
| D | 3.000 mm |

The dimple pattern was icosidodecahedral and comprised twelve pentagons each containing 26 dimples (total 312) and twenty triangles each containing 6 dimples (total 120), making 432 dimples in all.

Figure 5:
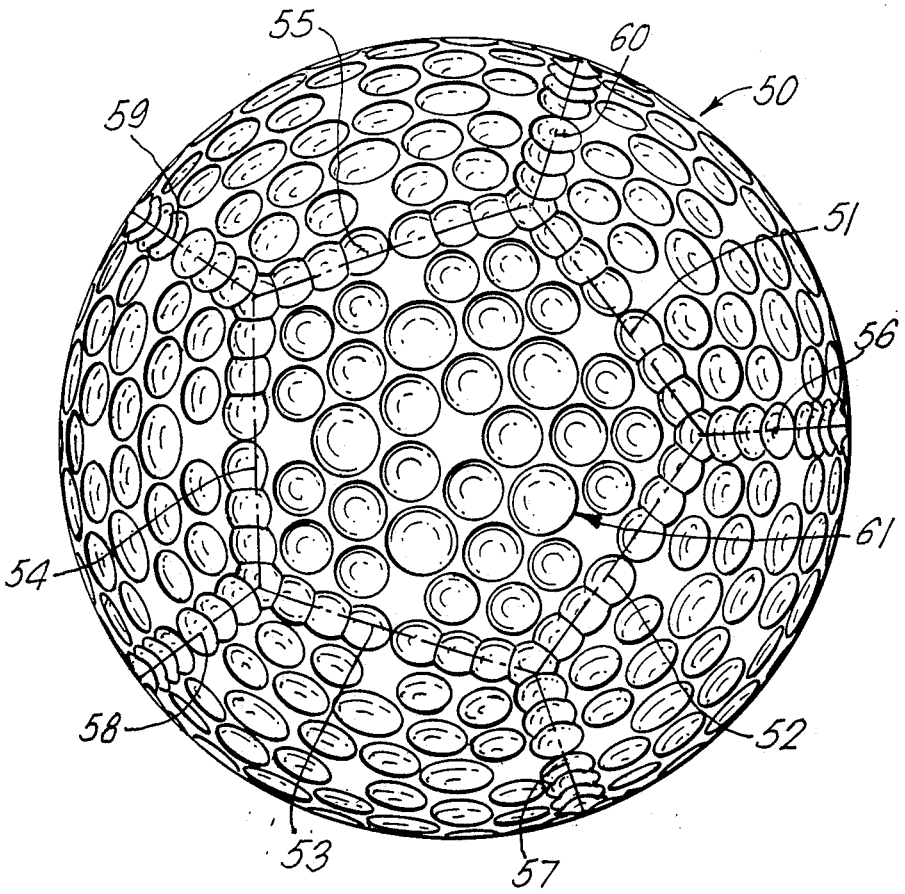
FIG. 5 is a perspective view of a golf ball according to a third preferred embodiment of the present invention.

In FIG. 5, a golf ball (indicated generally at 50) has a repeating dimple pattern indicated by chain-dotted lines 51, 52, 53, 54, 55, 56, 57, 58, 59 and 60. The said chain-dotted lines divide the spherical surface of the ball into twelve equal regular pentagons (one pentagon is indicated at 61 in FIG. 5).

Figure 6:
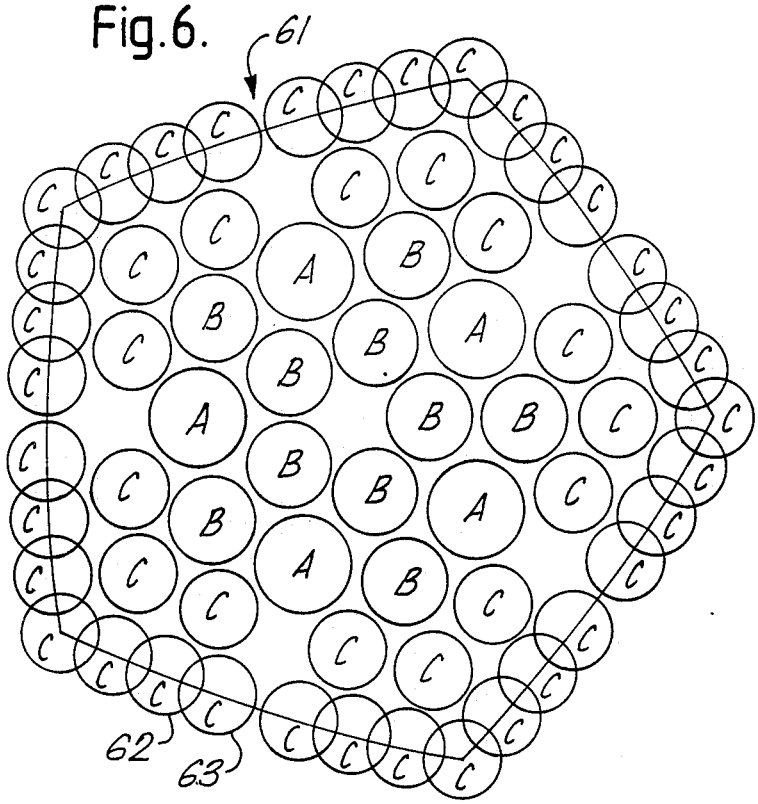
FIG. 6 is an enlarged view of a portion of the ball shown in FIG. 5.

In FIG. 6, pentagon 61 contains dimples of three different sizes, these being marked A,B and C respectively. Several pairs of adjacent dimples in each pentagon touch or overlap as shown in the drawings.

The ball illustrated in FIGS. 5 and 6 had the following dimple diameters:

| | |
|---|---|
| A | 3.810 mm |
| B | 3.353 mm |
| C | 3.000 mm |

The dimple pattern was dodecahedral and comprised twelve pentagons. The dimples numbered 560 in all and comprised:

60 of Diameter A 120 of Diameter B and 380 of Diameter C.

Figure 7:
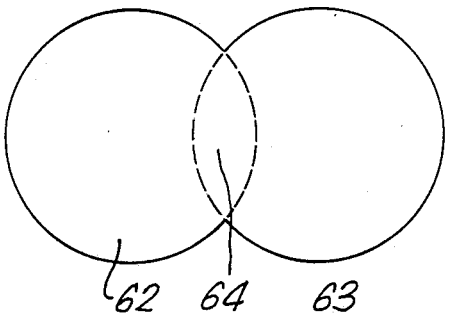
FIGS. 7 and 8 are schematic enlarged views of a pair of overlapping dimples of the ball shown in FIG. 5.
Figure 8:
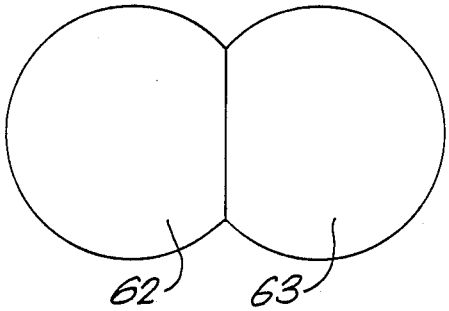

FIGS. 7 and 8 are enlarged views of a pair of the overlapping "C" dimples shown in FIG. 6 at 62 and 63.

In FIG. 7, dimples 62 and 63 extend inside each other to form an overlapping region 64. In the embodiment of the present invention shown in FIGS. 5,6, 7, and 8, the degree of overlap amounted to about 28% of the average dimple diameter.

FIG. 8 is a schematic view from above and shows how overlapping dimples 62 and 63 might appear to an observer.

I claim:

1. A golf ball having in its spherical outer surface a plurality of dimples, wherein at least 10% of said dimples are so disposed relative to one another that any two of said dimples which are adjacent each other extend inside each other to form an overlapping region, the minimum width of said overlapping region being greater than 0.02 inches (0.508 mm).

2. The golf ball of claim 1, wherein at least 20% of said dimples extend inside each other to form an overlapping region.

3. The golf ball of claim 1, wherein the minimum width of said overlapping region is greater than 0.025 inches (0.635 mm).

4. The golf ball of claim 1, wherein the minimum width of said overlapping region is greater than 0.03 inches (0.762 mm).

5. The golf ball of claim 1, wherein all said dimples are of equal diameter.

6. The golf ball of claim 1, wherein said dimples are of two or more different diameters and the width of said overlapping region is calculated on the diameter of the larger of any two of said overlapping dimples.

7. The golf ball of claim 1, wherein said dimples are arranged in a repeating pattern over the whole spherical outer surface of said ball, said pattern being defined by projecting on to said spherical outer surface the edges of a regular polyhedron selected from the group consisting of a cube, an octahedron, a dodecahedron, an icosahedron and an icosidodecahedron.

8. The golf ball of claim 1, wherein said dimples are of circular plan view.

9. The golf ball of claim 8, wherein said dimples have a three-dimensional configuration selected from the group consisting of part-spherical, part-ellipsoid, conical and frusto-conical.

10. The golf ball of claim 1, wherein said dimples are of non-circular plan view.

11. The golf ball of claim 10, wherein said dimples have a plan view selected from the group consisting of triangular, rectangular and polygonal.

12. The golf ball of claim 11, wherein said dimples have a three-dimensional configuration selected from the group consisting of tetrahedral, parallelepiped and pyramidal.

* * * * *